US005265914A

United States Patent [19]

Russell

[11] Patent Number: 5,265,914

[45] Date of Patent: Nov. 30, 1993

[54] DOCUMENT HOLDER

[76] Inventor: David G. Russell, 4912 Van Masdag Ct., Annandale, Va. 22003

[21] Appl. No.: 836,887

[22] Filed: Feb. 19, 1992

[51] Int. Cl.[5] ..... B42D 9/00

[52] U.S. Cl. ..... 281/42; 281/15.1; 281/29; 281/30; 402/8

[58] Field of Search ..... 281/15.1, 37, 21.1, 281/22, 29, 30, 36, 45, 42; 402/8, 70, 73, 75; 40/371, 383, 405

[56] References Cited

U.S. PATENT DOCUMENTS

| | | | |
|---|---|---|---|
| 347,613 | 8/1986 | Jenkins . | |
| 962,708 | 6/1910 | Kappenberg . | |
| 1,006,270 | 10/1911 | Planert . | |
| 1,158,251 | 10/1915 | McDougall . | |
| 1,184,069 | 5/1916 | Buck . | |
| 1,281,088 | 10/1918 | Smith . | |
| 1,363,120 | 12/1920 | Johnson | 281/42 |
| 1,521,481 | 12/1924 | Spencer . | |
| 1,577,272 | 3/1926 | Treadaway . | |
| 1,667,193 | 4/1928 | Coleman . | |
| 1,768,266 | 6/1930 | O'Connell . | |
| 1,800,362 | 4/1931 | Shipman . | |
| 1,815,024 | 7/1931 | Foster . | |
| 1,818,329 | 8/1931 | Horix . | |
| 1,890,840 | 12/1932 | Brewer . | |
| 2,085,259 | 6/1937 | Gunning . | |
| 2,089,313 | 8/1937 | Unger | 281/37 |
| 2,133,069 | 10/1938 | Williamson . | |
| 2,166,802 | 7/1939 | Daly . | |
| 2,263,154 | 11/1941 | Witting . | |
| 2,284,501 | 5/1942 | Welch . | |
| 2,312,190 | 2/1943 | Pitt | 281/37 |
| 2,528,695 | 11/1950 | King . | |
| 2,539,727 | 1/1951 | Clark . | |
| 2,614,305 | 10/1952 | Yeardley . | |
| 2,636,751 | 4/1943 | Carlson . | |
| 2,658,773 | 11/1953 | Tarris . | |
| 3,167,328 | 1/1965 | Dengle et al. | 281/36 X |
| 4,932,520 | 6/1990 | Ciarcia et al. | 281/31 X |

*Primary Examiner*—Mark Rosenbaum
*Assistant Examiner*—Willmon Fridie, Jr.
*Attorney, Agent, or Firm*—Burns, Doane, Secker & Mathis

[57] ABSTRACT

A document holder is disclosed including a semi-rigid inner member extending along at least a portion of the length of the holder. A layer of padding material is provided on one side of the inner member and a protective outer layer covers the padding material on the inner member. A suitable arrangement for securing at least one document against the inner member is provided along with a hinge that permits one portion of the holder to be folded over against the inner member in order to protect the document.

12 Claims, 2 Drawing Sheets

DOCUMENT HOLDER

BACKGROUND AND SUMMARY OF THE INVENTION

The present invention generally relates to document holders, and more particularly, to an apparatus for holding and protecting a golf scorecard.

In the game of golf, it is customary to keep score on a scorecard which is typically provided by the golf course. These cards are typically made of paper or thin cardboard and usually provide information concerning the distance and par score for each hole on the course. Golfers refer to these cards at the beginning of each hole in order to obtain information about the hole before teeing off. Golfers also use these scorecards to record their scores after completing each hole. Consequently, the scorecards are constantly being put into and taken out the scorekeeper's pocket or golf bag.

Golf scorecards are, in general, provided in a standard size which may not easily fit in a golf bag or a pocket. Consequently, the cards may become bent, folded, or otherwise mutilated during the course of a round of golf. Golf scorecards may be clipped to various writing surfaces which are sometimes provided on golf carts and golf bags. However, these writing surfaces are seldom protected from the elements so that the scorecard is often damaged by environmental conditions such as humidity, wind, rain, and the sun. In addition, the golfer's perspiration may damage the card if it is carried unprotected in a pocket. Moreover, if the card is not held on a proper writing surface, then the scorekeeper may be tempted to use the palm of his or her hand as a writing surface. In this case, the recorded score may not be legible, and the card may become damaged from the salts and oils on the surface of the scorekeeper's skin or from penetration of the writing implement through the card.

Most golf courses give away short pencils for recording scores on the card during a round of golf. These pencils often have very sharp points that can easily poke through the card, especially when used to write on a card that is supported by an improper writing surface. Moreover, if one of these pencils happens to be in a golfer's pocket or bag with the card, then the card is likely to receive extraneous markings from the loose pencil.

Golfers often carry additional cards in addition to the one blank scorecard for the current round. These additional cards may include other information about the golf course, such as previous scores, club choices, yardage, and strategies for any particular hole, e.g., a yardage booklet. Some golfers have even been known to carry notes for business discussions which may take place during the game. In any event, golfers often carry more than one card or note pad during any particular round of golf.

Conventional golf scorecard holders are typically made from a thin, flat, and stiff material such as a metal sheet. The scorecards are typically held on one side of the metal writing surface by a clip which protrudes from the plane of the metal sheet. Consequently, conventional golf scorecard holders may cause discomfort or tearing of clothes if they are stored in the golfer's pants or shirt pocket. Moreover, conventional golf scorecard holders lack means for covering and protecting the card when it is not in use and means for allowing more than one card to be used at a time.

In accordance with one aspect of the present invention, a holder includes a semi-rigid inner member extending along a portion of the length of the holder. A layer of padding material is provided on one side of the inner member with a protective outer layer that covers the padding material on the inner member. An arrangement for securing at least one document against the inner member is provided along with a hinge in the inner member for allowing the holder to fold over the document.

BRIEF DESCRIPTION OF THE DRAWINGS

The present invention will be described with reference to a preferred embodiment and with reference to the accompanying drawings, wherein like members bear like reference numerals, and wherein.

DETAILED DESCRIPTION OF THE PREFERRED EMBODIMENTS

Figure 1:
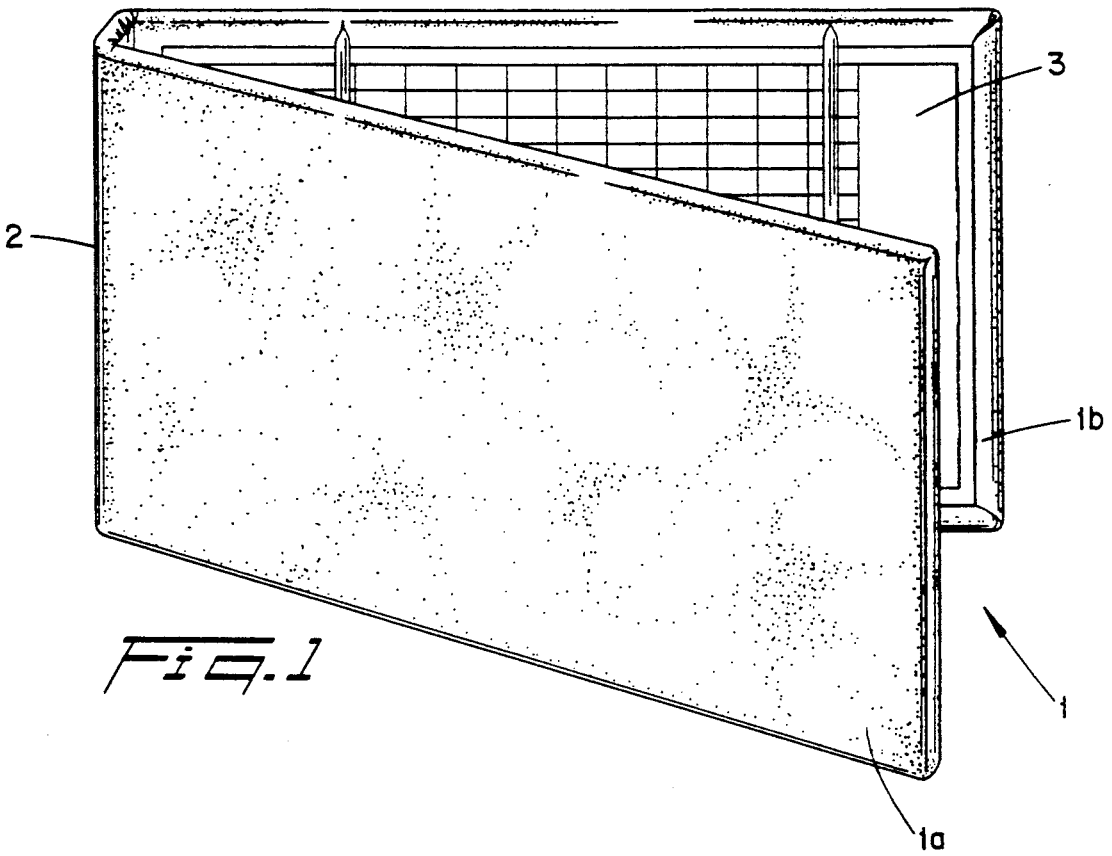
FIG. 1 illustrates the holder of the present invention in a partially open position.

FIG. 1 illustrates the present invention in a partially open position. The scorecard holder 1 includes two portions 1*a* and 1*b* which fold over each other at hinge area 2. A document 3, which may be a golf scorecard, is held against the inside surface of one of the portions by fasteners 4.

Figure 3:
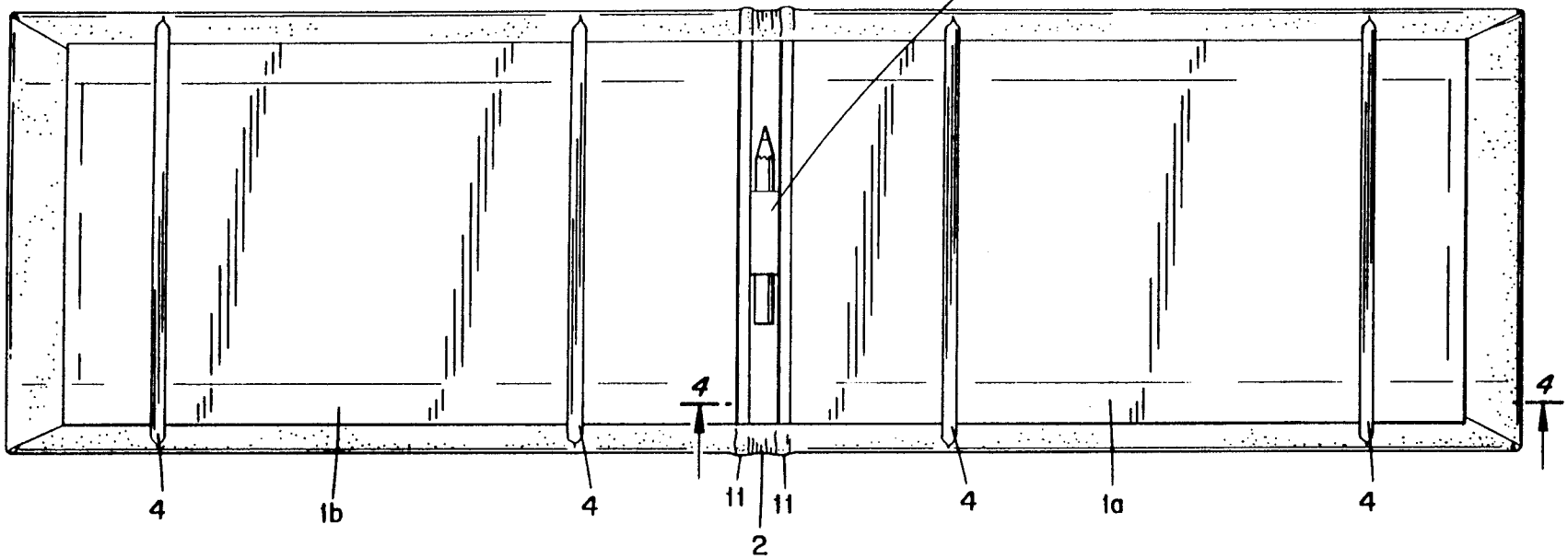
FIG. 3 illustrates a plan view of the inside of the holder of the present invention in an open position.

FIG. 3 illustrates a plan view of one embodiment of the present invention in a flat and fully open position. The holder 1 of the present invention includes the two continuous portions 1*a* and 1*b*. At least one of these portions is provided with a semi-rigid inner support member 5 (FIG. 4) that is used to support a scorecard or other material to be written on. That support surface provides a backing for writing on the document and a structural basis for the holder.

The fasteners 4 are preferably arranged so that they can secure a card to at least one of the portions 1*a*, 1*b* of the holder and hold the card flat against the smooth surface of inner protective layer 10. In a preferred embodiment, the fasteners 4 can be stretched away from the inside surfaces 1*a* and 1*b* of the holder 1 in order to allow a scorecard or other document to be slid under the fasteners on one or both sides of the holder. In this preferred embodiment, the fasteners 4 may be made from any flexible stretching material such as elastic, thread, wire, rubber, or coiled wire springs. The fasteners 4 are preferably fixed at each end to the inner member 5 by any conventional means such as glue or staples. The fasteners may also be clips preferably arranged within the structure of the holder without substantially projecting therefrom, e.g., a relatively flat, shaped metal wire. FIG. 3 illustrates two pairs of elastic bands on the inside of each half of the scorecard holder for holding two different cards. However, the device may also be used with a different number of elastic bands, as long as there is at least one band for holding each card.

Figure 4:
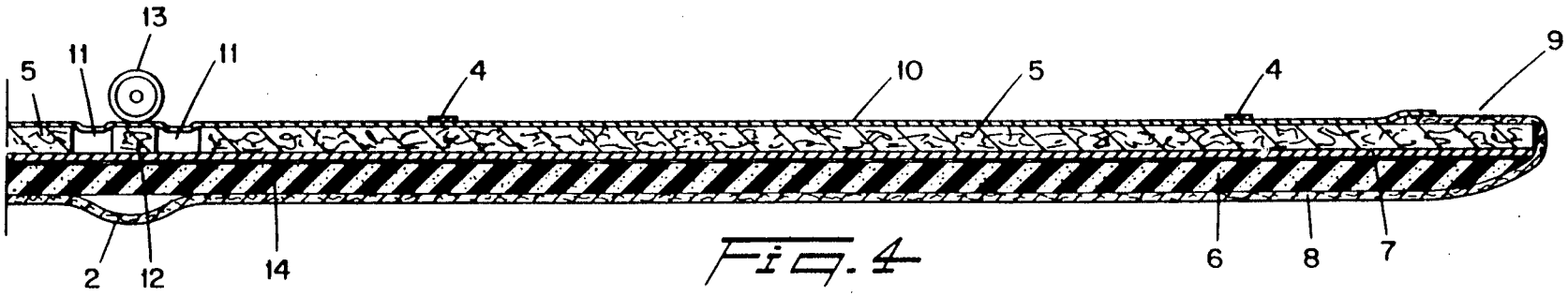
FIG. 4 illustrates a partial cross-section of the holder of the present invention taken along section line 4-4 in FIG. 3.

A cross-section of the device taken along section plane 4—4 of FIG. 3 is illustrated in FIG. 4. The inner support member 5 provides a semi-rigid support surface for backing a document which is to be written upon while in the holder. The inner member 5 is preferably formed from cardboard or plastic in at least two rectangular sections, one section for each portion 1*a*, 1*b* of the holder. However, the inner member 5 may also be formed from any other semi-rigid material such as fiber glass, compressed wood fiber, compressed textile fibers, or a suitably flexible plastic. The term semi-rigid, as used here, refers to a material which is hard enough to be written on and yet flexible enough to comfortably bend (without losing its structural integrity) when stored in the pocket of a golfer during walking, sitting, or swinging a golf club.

The device may also include at least one layer 7 which is preferably cemented to one side of the inner member, as illustrated in FIG. 4, or between a pair of inner members. The layer 7 is preferably paper or paper board which provides additional strength in hinge area 2 and aids in preventing the inner members from being damaged by moisture. The layer 7 also facilitates assembly of the holder by providing continuous structure for securement of the inner members and the padding material 6. The inner member 5 or the layer 7 is covered on one side with padding material 6. The inner member 5 may also be covered with padding material along its edges. The padding material 6 is preferably formed from ⅛ inch thick foam held on layer 7 by cement or white glue. However, the padding material 6 may be formed from any loosely consolidated natural or synthetic fiber, such as cotton, nylon, or foam rubber. The padding material 6 makes the holder 1 very comfortable to hold and wear in a pocket.

The padding material 6, the edges of the inner member 5, and the edges of the layer 7 are preferably covered with an outer protective layer 8. The outer protective layer 8 is preferably weatherproof and may be formed from vinyl sheet, leather, hide, or any other weather resistant coating material. The outer protective layer 8 may be glued, stapled, or otherwise fastened to the padding material 6 and/or to one side of the inner member 5 along ends 9 at each end of the holder. The outer protective layer may also be fastened to the side edges of the inner members. An inner protective layer 10 is then attached over the end portions 9 (and/or the side portions, not shown) of outer protective layer 8 by any suitable means such as gluing or stapling. Of course, the holder may also be completely covered on all sides by the same material as outer protective layer 8. The inner protective layer 10 should be water repellant in order to ensure that the inside of the holder remains relatively dry and can be easily cleaned. The inner protective layer 10 is preferably formed from artists paper, canvas paper, or the same material as outer protective layer 8. By providing uninterrupted outer and inner covering materials 8, 10, the chance of moisture reaching the layer 7 or the inner member 5 is minimized. The inner protective layer 10 also protects the inner member 5 from being punctured or dented by a pencil point when writing on a document in the holder.

The two rectangular sections or portions of inner member 5 are separated by at least one, but preferably two (FIG. 4) gaps at the hinge area 2 which allows portions 1*a* and 1*b* to be folded over each other. A backing strip of fabric tape 14 is preferably applied either to one side of layer 7 or directly to the portions of the inner member in the hinge area in order to provide additional support to layer 7 near the hinge. A hinge strip 12 preferably made of the same material as the inner member 5 provides additional stability and integrity for the holder 1 so that it is not easily crushed when placed in a user's pocket. As illustrated in FIG. 4, the paper board layer 7 and padding material 6 extend across the gaps to create two areas 11 on each side of the strip 12 that permit the holder to be folded over upon itself. Accordingly, when the device is folded about the areas 11, the scorecard (not shown in FIG. 4) is covered on its back and front sides by the inside of portions 1*a* and 1*b*.

The strip 12 and areas 11 are preferably wide enough to allow the holder 1 to be folded over a pencil retained against the strip 12. Strip 12 is therefore approximately ¼ inch wide when the total width of hinge area 2 is ½ inch. Strip 12 may also include means for securing or gripping the pencil, such as one or more loops 13. The loop 13 may be velcro, leather, or other suitable material for securing a pencil to the holder and is preferably one inch wide. Alternatively, the loop 13 could be replaced with a flat strip of velcro, affixed to the inner protective layer 10 by any suitable adhesive (including self adhesive velcro), which could then be attached to an opposite piece of velcro affixed to a pencil. Of course, each rectangular portion of inner member 5 could also be connected to strip 12 by any other conventional hinge means such as a simple cabinet hinge.

Figure 2:
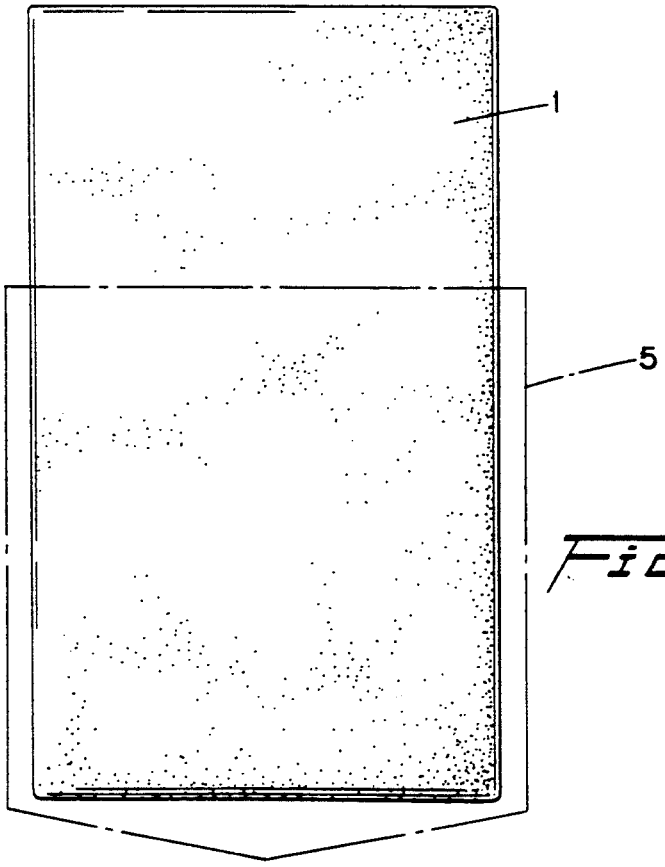
FIG. 2 illustrates the holder of the present invention in a closed position placed inside a pocket.

In normal use, one or more golf scorecards are slid underneath the fasteners 4 on either half of the holder 1. A pencil is then attached to the holder with the pencil holder 13 on the strip 12. The portion 1*a* of the scorecard holder is then folded over the portion 1*b* to sandwich the scorecard between the two inside surfaces of the scorecard holder with the pencil stored at one end of the holder. The holder 1 with the scorecard can then be perfectly fit inside a pocket, as illustrated in FIG. 2, without causing discomfort or tearing of the golfer's clothing. The holder is sized to fit easily in the average pocket. The semi-rigid members and the padding enhance the ability to comfortably fit within a pocket. The holder is then removed from the golfer's pocket and opened in order to record the score at the end of any particular hole.

FIG. 2 illustrates the scorecard holder 1 in a closed position with the halves folded over the scorecard 3 (not shown in FIG. 2) and slipped inside a pocket 5. The device is typically 4¼ to 4⅝ inches wide by 15 to 15¼ inches long in an open position so as to comfortably fit into a pocket when folded in half during walking, sitting, or swinging a golf club. The scorecard holder 1 is sized to hold any ordinary size golf scorecard, yardage booklet, or other paper as shown in FIG. 1 and to fit in an average size pocket as shown in FIG. 2.

The foregoing description should not be construed as limiting the present invention to the particular embodiments shown in the FIGURES. The description is intended to be merely illustrative rather than restrictive. Workers who are skilled in the art may make variations to the described embodiments without departing from the scope of the present invention as defined by the following claims.

I claim:

1. A document holder, comprising:

a semi-rigid inner member extending substantially throughout the length of the holder, said inner member being segmented into at least two portions which are spaced apart to form a gap therebetween;

a layer of padding material on one side of the inner member;

a protective outer layer that covers the padding material on the inner member;

means for securing at least one document against a first portion of the inner member; and hinge means for allowing a second portion of the inner member to fold over against said first portion of the holder, said hinge means including said gap.

2. A document holder as claimed in claim 1, further comprising a continuous material layer between the padding and the inner member to facilitate assembly.

3. A document holder as claimed in claim 1, further comprising means for reinforcing the hinge means.

4. A document holder as claimed in claim 3, wherein the means for reinforcing comprises fabric tape extending over said at least one gap.

5. A document holder as claimed in claim 1, further comprising a central, semi-rigid strip arranged in said gap between said first and second portions of said inner member.

6. A document holder as claimed in claim 5, wherein said central, semi-rigid strip is formed from the same material as said semi-rigid inner member.

7. A document holder as claimed in claim 5, further comprising means for securing a pencil to said central strip.

8. A document holder as claimed in claim 1, further comprising means for securing a pencil to an inside of said hinge means.

9. A document holder as claimed in claim 8, wherein the means for securing the pencil includes at least one velcro strip.

10. A document holder as claimed in claim 8, wherein the means for securing the pencil includes a fixed circular means.

11. A document holder, comprising:

a semi-rigid inner member extending substantially throughout the length of the holder;

a layer of padding material on one side of the inner member;

a protective outer layer that covers the padding material;

a protective inner layer that covers at least one side of the semi-rigid member;

at least one elastic band for securing at least one document against the inner member;

hinge means in the inner member for allowing one portion of the holder to fold over against another portion of the holder; and means for securing a pencil between the two folded portions of the holder in the area of the hinge means.

12. A holder as claimed in claim 11 wherein said inner member is segmented into at least two portions having a gap therebetween, said hinge means including a strip of semi-rigid material in said gap between said two portions.

* * * * *